US006917773B2

(12) United States Patent
Maeda et al.

(10) Patent No.: US 6,917,773 B2
(45) Date of Patent: Jul. 12, 2005

(54) IMAGE FORMING APPARATUS

(75) Inventors: Masahiro Maeda, Nagano (JP); Isao Inaba, Nagano (JP); Masanori Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/687,920

(22) Filed: Oct. 20, 2003

(65) Prior Publication Data

US 2004/0175201 A1 Sep. 9, 2004

(30) Foreign Application Priority Data

Oct. 18, 2002 (JP) ..... P2002-303908
Oct. 18, 2002 (JP) ..... P2002-303909
Oct. 18, 2002 (JP) ..... P2002-303910
Oct. 18, 2002 (JP) ..... P2002-303911

(51) Int. Cl.[7] ..... G03G 15/02

(52) U.S. Cl. ..... 399/92; 250/324; 399/171; 399/172

(58) Field of Search ..... 399/170, 171, 399/172, 173, 168, 92, 311; 250/324, 325, 326; 361/225

(56) References Cited

U.S. PATENT DOCUMENTS 4,745,282 A * 5/1988 Tagawa et al. ..... 250/326
4,922,303 A * 5/1990 Takeda et al. ..... 399/92
5,018,045 A * 5/1991 Myochin et al. ..... 250/324 X
5,291,247 A * 3/1994 DeCecca ..... 399/92
5,351,111 A * 9/1994 Takafuji et al. ..... 399/171
5,742,874 A * 4/1998 Koshimura et al. ..... 399/173 X
6,411,788 B1 * 6/2002 Ogasawara ..... 399/92

FOREIGN PATENT DOCUMENTS

JP 05-094076 A * 4/1993
JP 06-236096 A * 8/1994
JP 6-43815 Y2 11/1994
JP 08-171254 A * 7/1996
JP 09-230668 A * 9/1997
JP 10-142900 A * 5/1998
JP 11-052685 A * 2/1999
JP 2003-241484 A * 8/2003

* cited by examiner

*Primary Examiner*—Sophia S. Chen
(74) *Attorney, Agent, or Firm*—Sughrue Mion, PLLC

(57) ABSTRACT

The surface of a photosensitive body is charged by a scorotron charger including a discharge electrode, a back plate having an aperture on the bottom face, and a grid. Air is passed along the back plate for ventilation. The back plate also has a vent aperture on the side face. The aperture rate of the aperture on the bottom face of the part corresponding to the vent aperture is set lower than that on the bottom face of the other part, in the axial direction of the charger.

5 Claims, 9 Drawing Sheets

IMAGE FORMING APPARATUS

The present application is based on Japanese Patent Applications Nos. 2002-303908, 2002-303909, 2002-303910 and 2002-303911, the entire contents of which are incorporated herein by reference.

BACKGROUND OF THE INVENTION

1. Field of the Invention

The present invention relates to an image forming apparatus for printers, facsimiles, copying machines and so on to form an image with an electrophotographic technique. More particularly, it relates to a technique for charging its photosensitive body with a corona discharger.

2. Related Art

Generally, an image forming apparatus using an electrophotography technology includes a photosensitive body having a photosensitive layer at an outer peripheral face thereof, a charging unit for uniformly charging the outer peripheral face of the photosensitive body, an exposing unit for forming an electrostatic latent image by selectively exposing the outer peripheral face charged uniformly by the charging unit, a developing unit for constituting a visible image (toner image) by providing a toner which is a developing agent to the electrostatic latent image formed by the exposing unit and a transcribing unit for transcribing the toner image developed by the developing unit onto a record member of sheet or the like which is a transcribing object.

There is known charging unit for charging the outer peripheral face of the photosensitive body utilizing a corona discharger referred to as a scorotron charger. The scorotron charger includes a discharge electrode, a supporting member for supporting the discharge electrode, a back plate for carrying out stable discharge and a grid for controlling charge potential on the photosensitive body. When charging is carried out, for example, by applying a voltage of −4KV through −6KV to the discharge electrode, applying −600V (potential dependent on potential intended to charge actually) to a grid and grounding the back plate or applying a potential the same as that of the grid to the back plate, corona discharge is generated from the discharge electrode and the photosensitive body can be charged to about −600V.

Since the scorotron charger as described above uses corona discharge, generation of ozone is inevitable. Ozone is known to degrade the photosensitive body and the charger, resulting in an inferior image formation.

Accordingly, the conventional chargers have a blast aperture on a back side thereof extending along the axial direction of the charger and a blast duct is provided on the back face side, so that the ozone is discharged from the charger with air supplied from one end of the duct (for example, refer to JP-H06-43815-Y2, p. 1, FIG. 1).

In the related art described above, however, as the ventilation of ozone is insufficient, partial degradation of the discharge electrode gradually promotes, causing non-uniform electricity discharging in a low temperature and low humidity environment. As a result, an inferior image with so-called "charging unevenness" is formed.

The inventors have investigated the cause and found that it is due to partial residence of ozone in the charger (particularly, on the downstream side of the air flow).

It has also been found that in order to solve the problem, it is desirable that the back plate has a vent aperture on the side face of the charger (for example, on the side face at the downstream side of the air flow) to efficiently discharge the ozone from the charger.

On the other hand, it has also been found that providing the vent aperture on the side face of the back plate decreases the absolute value of charge potential on the photosensitive body at the corresponding area to the vent aperture. Thus uniformity of the charge potential is deteriorated. For example, when an aperture of about 8 mm in width and 50 mm in length is provided on the side face of the back plate, the absolute value of the charge potential is decreased by about 20V. This is not a negligible difference in view of the recent requirement for high-quality color image. In general, in order to obtain a preferable color image in the image forming apparatus, it is desirable that the in-plane variation in charge potential (variation in the axial direction of the photosensitive body) is not larger than 20V. However, it is difficult to achieve such the uniformity due to the influence of the tolerances of components constituting the charger. Therefore, under such situations, there arises a serious drawback if the charger is configured to have a potential difference about 20V in the axial direction of the photosensitive body in the initial state.

SUMMARY OF THE INVENTION

Accordingly, it is an object of the present invention to provide an image forming apparatus in which the above-described problems are solved and which is capable of uniformizing the charge potential on the surface of a photosensitive body, particularly, uniformizing the charge potential over the entire maximum image-formation width of the photosensitive body.

In order to achieve the above object, an image forming apparatus includes a photosensitive body; and a charger including a discharge electrode and a back plate for charging a surface of the photosensitive body, the back plate having an aperture on a bottom face thereof and a vent aperture on a side face thereof. An airflow is provided along the back plate so that air is discharged. An aperture rate or a first part of the bottom face corresponding to the vent aperture on the side face in an axial direction of the charger is lower than an aperture rate of a second part of the bottom face.

The image forming apparatus as described above offers the following advantages.

Since the back plate has a vent aperture on the side face, ozone in the charger can be discharged through the vent aperture efficiently and sufficiently.

Accordingly, partial degradation of the discharge electrode is prevented so that the electricity is discharged uniformly, even in the low-temperature and low-humidity environment where the corona discharge becomes unstable.

If no measures are taken when the vent aperture is provided, the absolute value of charge potential on the photosensitive body at the area corresponding to the vent aperture would be decreased, as described above.

On the other hand, according to the invention, the aperture rate of the bottom face of the part corresponding to the vent aperture in the axial direction of the charger is lower than that of the bottom face of the other part, thus preventing a decrease in the absolute value of the charge potential of the photosensitive body. This is because the part having a lower bottom face aperture rate has higher electrical discharge as compared with that of the other part.

Thus, according to the invention, the charge potential on the surface of the photosensitive body can be uniformized.

In order to achieve the above object, an image forming apparatus of the invention includes a photosensitive body; and a charger including a discharge electrode, a back plate and a grid for charging a surface of the photosensitive body, the back plate having a vent aperture on a side face thereof. An airflow is provided along the back plate so that air is discharged. A grid aperture rate of a first part of the grid corresponding to the vent aperture in an axial direction of the charger is higher than a grid aperture rate of a second part of the grid.

According to the image forming apparatus as described above, the grid aperture rate of the part corresponding to the vent aperture is higher than that of the other part in the axial direction of the charger, thus preventing a decrease in the absolute value of the charge potential of the photosensitive body. This is because the part having a higher aperture rate has higher charging capability (capability of charging the photosensitive body) as compared with that of the other part.

Thus, according to the invention, the charge potential on the surface of the photosensitive body can be uniformized.

In order to achieve the above object, an image forming apparatus of the invention includes a photosensitive body; and a charger including a discharge electrode and a back plate for charging a surface of the photosensitive body, the back plate having an aperture on a side face thereof extending in an axial direction of the charger with a uniform width and a length larger than a predetermined length needed for image-formation on the photosensitive body. An airflow is provided along the back plate so that air is discharged. An insulating sheet is applied to an outer face of the back plate so as to cover a portion of the aperture while leaving another portion of the aperture uncovered, constituting a vent aperture.

According to the image forming apparatus as described above, since the aperture has a length larger than the predetermined length (that is, the maximum image-formation width) formed on the photosensitive body and a uniform width in the axial direction of the charger, the entire maximum image-formation width formed by the photosensitive body is given a uniform electrical discharge. As a result, the entire maximum image-formation width formed by the photosensitive body can be given a uniform charge potential.

In order to achieve the above object, an image forming apparatus of the invention includes a photosensitive body; and a charger including a discharge electrode and a back plate for charging a surface of the photosensitive body, the back plate having the back plate has a vent aperture on a side face thereof. An airflow is provided along the back plate so that air is discharged. An insulating sheet extending in the axial direction of the charger with a width substantially equal to a width of the vent aperture is applied to an inner surface of the side face on which the vent aperture is not formed.

The maximum image-formation width t defined on the photosensitive body is preferably expressed as $$t \leqq Th+Ts$$

where Th is the axial length of the vent aperture and Ts is the axial length of the insulating sheet.

According to the image forming apparatus as described above, since an insulating sheet having a width substantially equal to that of the vent aperture is applied to the inner surface of the side face of the back late in the axial direction of the charger, a uniform charge potential can be given on the surface of the photosensitive body. This is because, although the part having the vent aperture decreases in the electric discharge by the charger to decrease the absolute value of the charge potential of the photosensitive body at the part corresponding to that part, when the insulating sheet having a substantially equal width to the width of the vent aperture is applied to the inner surface of the side face of the back plate where the vent aperture is not formed, electric discharge by the charger is decreased also at the applied part, so that the absolute value of the charge potential on the surface of the photosensitive body at the part corresponding to that part is also decreased.

Thus, according to the invention, the charge potential on the surface of the photosensitive body can be uniformized.

The maximum image-formation width t defined on the photosensitive body is expressed as $$t \leqq Th+Ts$$

where Th is the axial length of the vent aperture and Ts is the axial length of the insulating sheet. As a result, the entire maximum image-formation width formed by the photosensitive body can be given a uniform charge potential.

BRIEF DESCRIPTION OF THE DRAWINGS

FIG. 2A is a graph of a change in charge potential in the axial direction of a photosensitive body 21 without correction by aperture rate of a bottom face of a back plate, FIG. 2B is a schematic left side view of an image carrier unit, FIG. 2C is a front view of the charger shown in FIG. 2B viewed from front, and FIG. 2D is a bottom view of the charger;

FIG. 4A is a graph of a change in charge potential in the axial direction of a photosensitive body without correction by grid aperture rate, FIG. 4B is a schematic left side view of an image carrier unit, FIG. 4C is a front view of the charger shown in FIG. 4B viewed from front, FIG. 4D is a bottom view of the charger, FIG. 4E is a plan view of the charger, FIG. 4F is an enlarged view of part f in FIG. 4E, and FIG. 4G is an enlarged view of part g in FIG. 4E;

FIGS. 6A to 6D are diagrams of essential parts of a third embodiment, wherein FIG. 6A is a graph of a change in charge potential on the surface of a photosensitive body in the axial direction when the aperture is not longer than the maximum image-formation width formed by the photosensitive body, FIG. 6B is a schematic left side view of the image carrier unit, FIG. 6C is a front view of the charger shown in FIG. 6B, and FIG. 6D is a front view of an insulating sheet:

FIGS. 8A to 8D are diagrams of essential parts of a fourth embodiment, wherein FIG. 8A is a graph of a change in charge potential on the surface of the photosensitive body in the axial direction without correction by the addition of the insulating sheet, FIG. 8B is a schematic left side view of the image carrier unit, FIG. 8C is a front view of the charger shown in FIG. 8B, and FIG. 8D is a front view of the insulating sheet.

DETAILED DESCRIPTION OF THE PREFERRED EMBODIMENTS

Embodiments of the present invention will be described with reference to the drawings.

Figure 1:
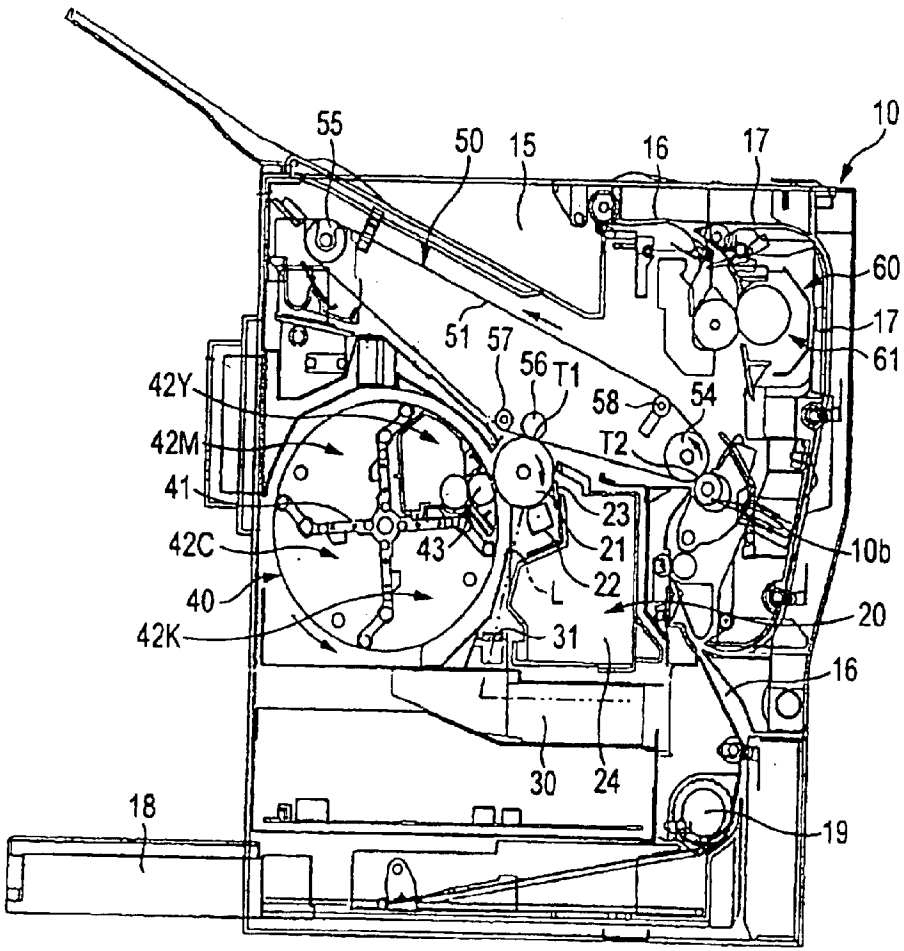
FIG. 1 is a schematic front view of an internal structure of an image forming apparatus according to the present invention.

FIG. 1 is a schematic front view of an internal structure of an image forming apparatus according to a series of embodiments of the present invention.

The image forming apparatus is a color-image forming apparatus capable of forming a full-color image on both faces of A3-size paper (record member) and includes a casing 10 and an image carrier unit 20, an exposure unit 30 serving as exposing means, a developer (developing device) 40 serving as developing means, an intermediate transcription unit 50, and a fixing unit (fixer) 60 serving as fixing means, which are housed in the casing 10.

The casing 10 has the frame (not shown) of an apparatus main body, to which the units are mounted.

The image carrier unit 20 includes a photosensitive body (image carrier member) 21 having a photosensitive layer on the outer circumference and a charging device (scorotron charger) for uniformly charging the outer circumference of the photosensitive body 21. The outer circumference of the photosensitive body 21 which is uniformly charged is selectively exposed to laser light L from the exposure unit 30 to form an electrostatic latent image. The electrostatic latent image is provided with toner acting as developer by the processing machine 40 into a visible image (toner image). The toner image is primarily transferred to an intermediate transfer belt 51 of the intermediate transcription unit 50 by a primary transcription section T1 and then secondarily transferred to transfer paper by a secondary transcription section T2.

The image carrier unit 20 includes a cleaner (cleaning blade) 23 for removing toner remaining on the surface of the photosensitive body 21 after the primary transcription and a waste-toner container 24 for housing the waste toner removed by the cleaner 23.

The casing 10 includes a carrier path 16 for carrying the paper having an image on one face formed by the secondary transcription section T2 toward a paper ejecting section (output tray) 15 on the top of the casing 10 and a return path 17 for switching back the paper carried to the paper ejecting section 15 through the carrier path 16 toward the secondary transcription section T2 so as to form an image on the other face.

The casing 10 also includes a paper feed tray 18 for holding a stack of paper at the lower part and a paper feed roller 19 for feeding the paper toward the secondary transcription section T2 one by one.

The processing machine 40 is a rotary processing machine and includes a plurality of processing machine cartridges each having a toner detachably mounted to a rotating body 41. This embodiment includes a yellow processing-machine cartridge 42Y, a magenta processing-machine cartridge 42M, a cyan processing-machine cartridge 42C, and a black processing-machine cartridge 42K (only the yellow processing-machine cartridge 42Y is illustrated). The rotating body 41 is driven in the direction of the arrow at a pitch of 90 degrees to selectively bring a developing roller 43 into contact with the photosensitive body 21, thereby allowing selective development of the surface of the photosensitive body 21.

The exposure unit 30 emits the laser light L through an exposure window 31 made of plate glass or the like toward the photosensitive body 21.

The intermediate transcription unit 50 includes a unit frame (not shown), a driving roller 54 rotatably supported by the frame, a driven roller 55, a primary transfer roller 56, a guide roller 57 for stabilizing the condition of the intermediate transfer belt 51 in the secondary transcription section T2, a tension roller 58, and the intermediate transfer belt 51 stretched around the rollers. The intermediate transfer belt 51 is driven to circulate in the direction of the arrow. The primary transcription section T1 is formed between the photosensitive body 21 and the primary transfer roller 56. The secondary transcription section T2 is formed at the pressure contact part between the driving roller 54 and a secondary transfer roller 10*b* provided adjacent to the main body.

The secondary transfer roller 10*b* can be brought into and out of contact with the driving roller 54 (or the intermediate transfer belt 51) and when it comes in contact, the secondary transcription section T2 is formed.

Accordingly, in order to form a color image, multicolor toner images are superposed on the intermediate transfer belt 51 with the secondary transfer roller 10*b* separated from the intermediate transfer belt 51 to form a color image. The secondary transfer roller 10*b* is then brought into contact with the intermediate transfer belt 51 and paper is fed to the contact part (secondary transcription section T2), so that the color image (toner image) is transferred onto the paper.

The paper on which the toner image is transferred passes through a heating roller pair 61 of the fixing unit 60 to have the toner image fixed by melting and is then ejected toward the paper ejecting section 15.

The fixing unit 60 is an oilless fixing unit that applies no oil to the heating roller pair 61.

<First Embodiment>

Figure 2A:
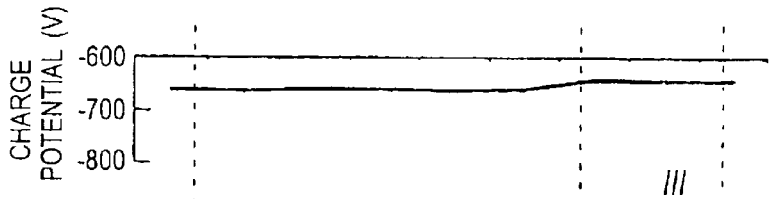
FIGS 2A to 2D show essential parts of the invention.
Figure 2B:
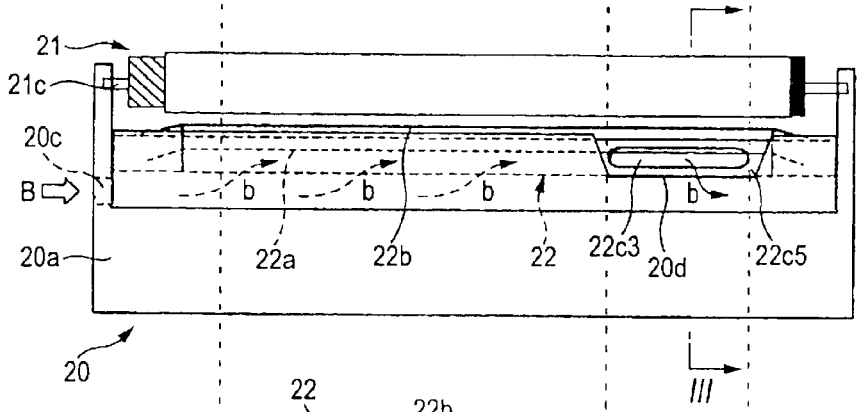
Figure 2C:
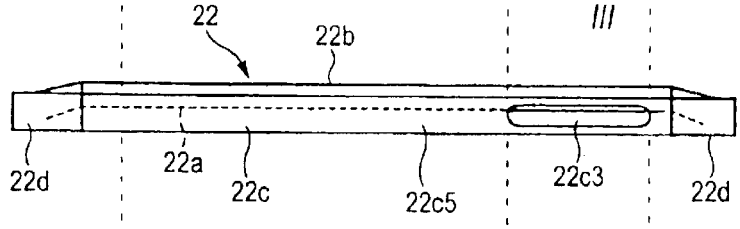
Figure 2D:
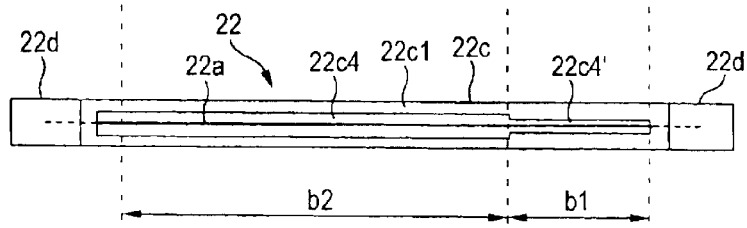
Figure 3:
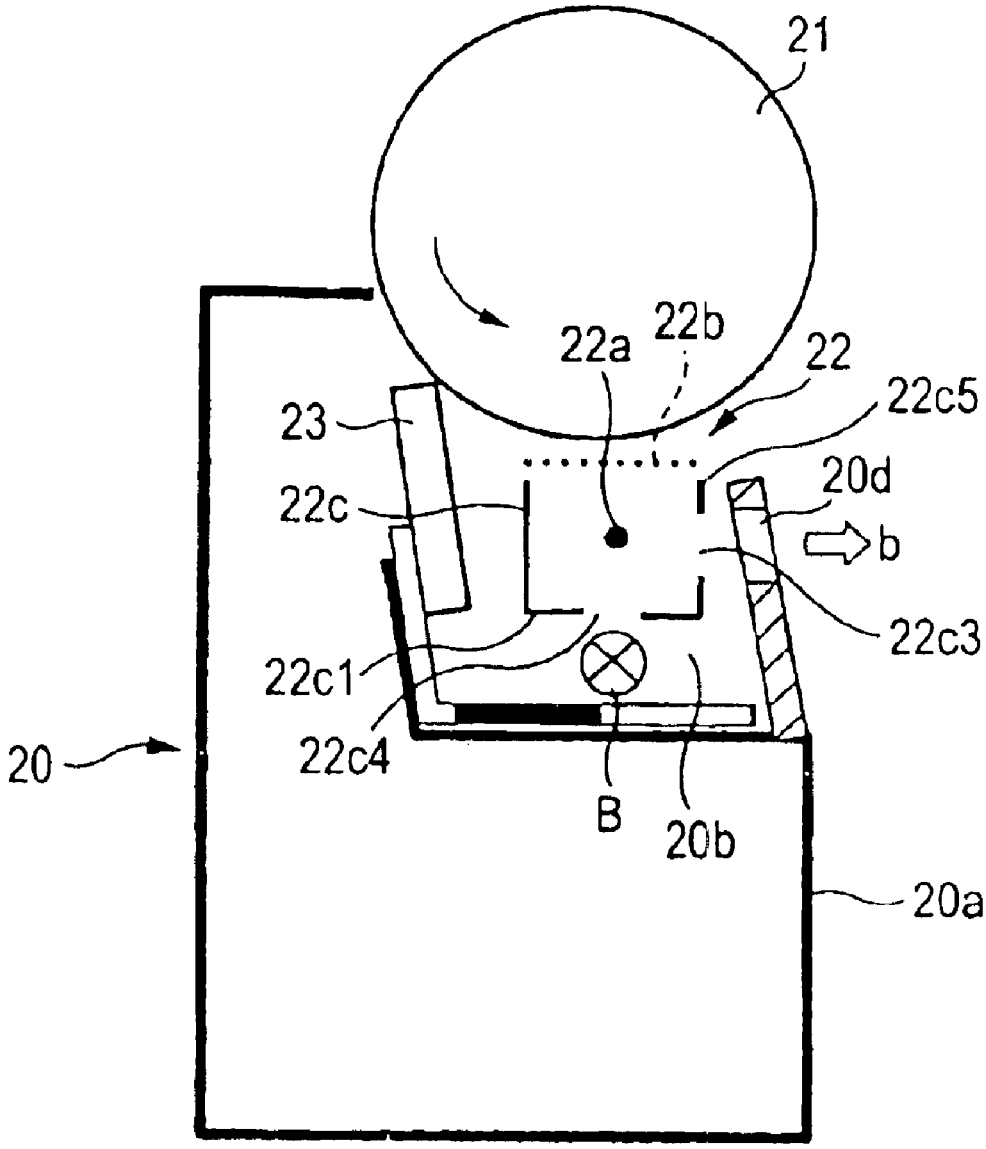
FIG. 3 is a sectional view (schematic view) taken along line III—III of FIG. 2B.

FIGS. 2A to 2D are diagrams of essential parts thereof, wherein FIG. 2A is a graph of a change in charge potential in the axial direction of a photosensitive body 21 without correction depending on the aperture rate of the bottom face of a back plate, FIG. 2B is a schematic left side view of an image carrier unit 20, FIG. 2C is a front view of a charger 22 with FIG. 2B viewed from front, and FIG. 2D is a bottom view of the charger 22. FIG. 3 is a sectional view (schematic view) taken along line III—III of FIG. 2B.

As FIG. 2B shows, the charger 22 according to this embodiment is a scorotron charger including a wire-like discharge electrode 22*a*, a back plate 22*c* for discharging electricity with stability, and a grid 22*b* for controlling charge potential on the photosensitive body 21.

The back plate 22*c* has a vent aperture 22*c*3 in one side face 22*c*5.

The back plate 22*c* also has an aperture 22*c*4 on the bottom face 22*c*1, as shown in FIG. 2D. The aperture rate of the bottom face aperture 22*c*4 is set low at a first part b1 (refer to FIG. 2D) corresponding to the vent aperture 22*c*3 and high at a second part b2 (refer to FIG. 2D) in the axial direction of the charger 22 (laterally in FIG. 2D).

For example, as FIG. 2D shows, the first part b1 corresponding to the vent aperture 22*c*3 has a relatively small aperture 22*c*4' so that the aperture rate is low and the second part b2 has the relatively large aperture 22*c*4 so that the aperture rate is relatively high.

Decreasing the bottom face aperture rate increases electric discharge, thus increasing charging capability (capability to charger the photosensitive body 21).

Therefore, the charging capability by the charger 22 is high at the first part b1 corresponding to the vent aperture 22*c*3.

Referring to FIG. 2B, the photosensitive body 21 is rotatably supported to a casing 20*a* of the image carrier unit 20 with its shaft 21*c* and is driven to rotate by a driving mechanism (not shown).

The charger 22 is fixed to the casing 20*a*. A pair of left and right support members 22*d* for supporting the discharge electrode 22*a* and the grid 22*b* is fixed to both ends of the back plate 22*c*.

Referring also to FIG. 3, the casing 20*a* of the image carrier unit 20 includes a duct 20*b*. The duct 20*b* is formed like a substantially U-shape in cross section so as to surround the lower part of the charger 22 and has an air inlet (blast aperture) 20*c* at one end (refer to FIG. 2B) and an exhaust aperture 20*d* at the part opposed to the vent aperture 22*c*3 of the back plate 22*c* at the other end.

Therefore, as shown by arrow b in FIG. 2B, air B flows from the air inlet 20*c* through the aperture 22*c*4 on the bottom face of the back plate 22*c* into the charger 22 and is discharged to the exterior of the image carrier unit 20 through the vent aperture 22*c*3 on the side face and the exhaust aperture 20*d* of the duct 20*b*.

The image forming apparatus includes the charger 22 including the discharge electrode 22*a* and the back plate 22*c* having an aperture 22*c*4 on the bottom face, for charging the surface of the photosensitive body 21. An airflow for ventilation by passing air along the back plate 22*c* is provided so that air is discharged to the exterior. The back plate 22*c* has the vent aperture 22*c*3 on the side face 22*c*5. The aperture rate of the bottom face of the first part b1 corresponding to the vent aperture 22*c*4 in the axial direction of the charger 22 is set lower than that of the bottom face of the second part b2. Thus the image forming apparatus offers the following advantages.

In other words, since the back plate 22*c* has the vent aperture 22*c*3 on the side face 22*c*5, ozone in the charger 22 is discharged efficiently and sufficiently through the vent aperture 22*c*3.

Accordingly, partial degradation of the discharge electrode 22*a* is prevented to discharge electricity uniformly even in low-temperature and low-moisture environment in which corona discharge is unstable.

On the other hand, if no measures are taken when the vent aperture 22*c*3 is provided, the absolute value of the charge potential of the photosensitive body 21 at the first part b1 corresponding to the vent aperture 22*c*3 would be decreased, as described above (refer to FIG. 2A).

However, the image forming apparatus has smaller aperture rate of the bottom face of the first part b1 corresponding to the vent aperture 22*c*4 in the axial direction of the charger 22 as compared with that of the bottom face of the second part b2, thus preventing a decrease in the absolute value of the charge potential of the photosensitive body. This is because the first part b1 having a lower bottom face aperture rate has higher charging capability (capability of charging the photosensitive body) as compared with that of the second part b2.

Thus, the charge potential on the surface of the photosensitive body can be uniformized.

<Second Embodiment>

Figure 4A:
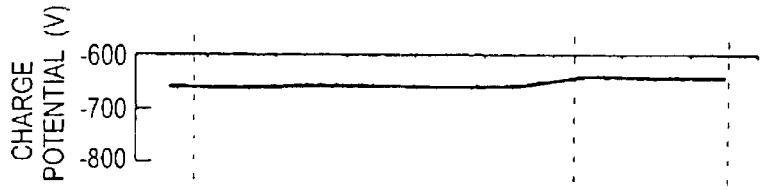
FIGS. 4A to 4G are diagrams of essential parts of a second embodiment.
Figure 4B:
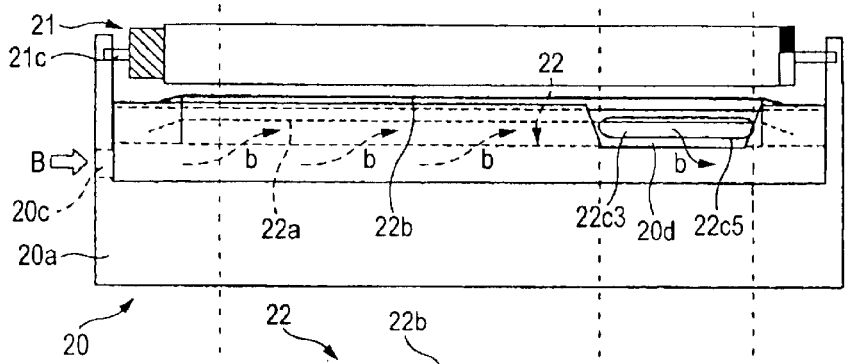
Figure 4C:
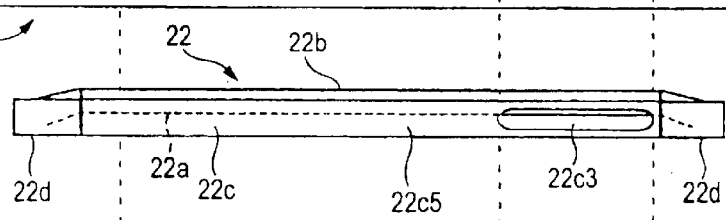
Figure 4D:
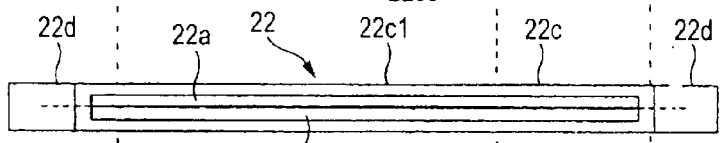
Figure 4E:
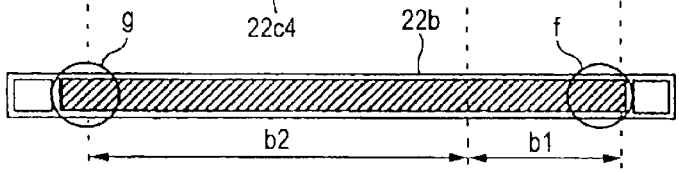
Figure 4G:
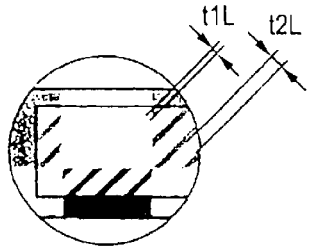
Figure 4F:
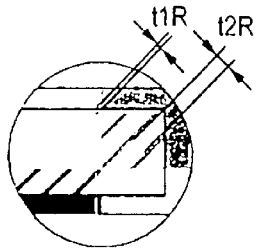

FIGS. 4A to 4G are diagrams of essential parts of a second embodiment, wherein FIG. 4A is a graph of a change in charge potential in the axial direction of the photosensitive body 20 without correction depending on the grid aperture rate, FIG. 4B is a schematic left side view of the image carrier unit 20, FIG. 4C is a front view of the charger 22 with FIG. 4B viewed from front, FIG. 4D is a bottom view of the charger 22, FIG. 4E is a plan view of the charger 22, FIG. 4F is an enlarged view of part f in FIG. 4E, and FIG. 4G is an enlarged view of part g in FIG. 4E. In the drawings, components same as or corresponding to those of the first embodiment are given the same reference numerals.

In this embodiment, the grid aperture rate of the first part b1 (refer to FIG. 4E) corresponding to the vent aperture 22*c*3 in the axial direction of the charger 22 (laterally in FIG. 4D) is higher than that of the second part b2 (refer to FIG. 4E).

For example, as FIG. 4F shows, open-area width t2R at the first part b1 corresponding to the vent aperture 22*c*3 is increased by relatively deceasing the electrode width t1R of the grid 22*b*. As FIG. 4G shows. The open-area width t2L of the second part b2 is relatively decreased by relatively increasing the electrode width t1L of the grid 22*b*.

Increasing the aperture rate of the grid 22*b* increases charging capability (capability to charge the photosensitive body 21), while decreasing the aperture rate decreases also the charging capability.

Therefore, the charging capability of the charger 22 is high at the first part b1 corresponding to the vent aperture 22*c*3.

The casing 20*a* of the image carrier unit 20 includes the duct 20*b*, as in the first embodiment. The duct 20*b* is formed like a substantially U-shape in cross section so as to surround the lower part of the charger 22 and has the air inlet (blast aperture) 20*c* at one end (refer to FIG. 4B) and the exhaust aperture 20*d* at the part opposed to the vent aperture 22*c*3 of the back plate 22*c* at the other end.

Referring to FIG. 4D, the back plate 22*c* of the charger 22 has the rectangular aperture 22*c*4 on the bottom face 22*c*1.

Therefore, as shown by arrow b in FIG. 4B, air B flows from the air inlet 20*c* through the aperture 22*c*4 on the bottom face of the back plate 22*c* into the charger 22 and is discharged to the exterior of the image carrier unit 20 through the vent aperture 22*c*3 on a side part of the back plate 22 and the exhaust aperture 20*d* of the duct 20*b*.

The image forming apparatus includes the scorotron charger 22 having the discharge electrode 22*a*, the back plate 22*c*, and the grid 22*b*, for charging the surface of the photosensitive body 21. An airflow for ventilation by passing air along the back plate 22*c* is provided so that air is discharged to the exterior. The back plate 22*c* has the vent aperture 22*c*3 on the side face 22*c*5. The grid aperture rate of the part corresponding to the vent aperture 22*c*3 in the axial direction of the charger 22 is set higher than that of the other part. Thus, the image forming apparatus offers the same advantages as those of the first embodiment.

In other words, the image forming apparatus has higher grid aperture rate at the first part b1 corresponding to the vent aperture 22*c*4 in the axial direction of the charger 22 as compared with that of the second part b2, thus preventing a decrease in the absolute value of the charge potential of the photosensitive body 21. This is because the first part b1 having a higher grid aperture rate has higher charging capability (capability of charging the photosensitive body) as compared with that of the second part b2.

Thus, the charge potential on the surface of the photosensitive body can be uniformized.

Figure 5:
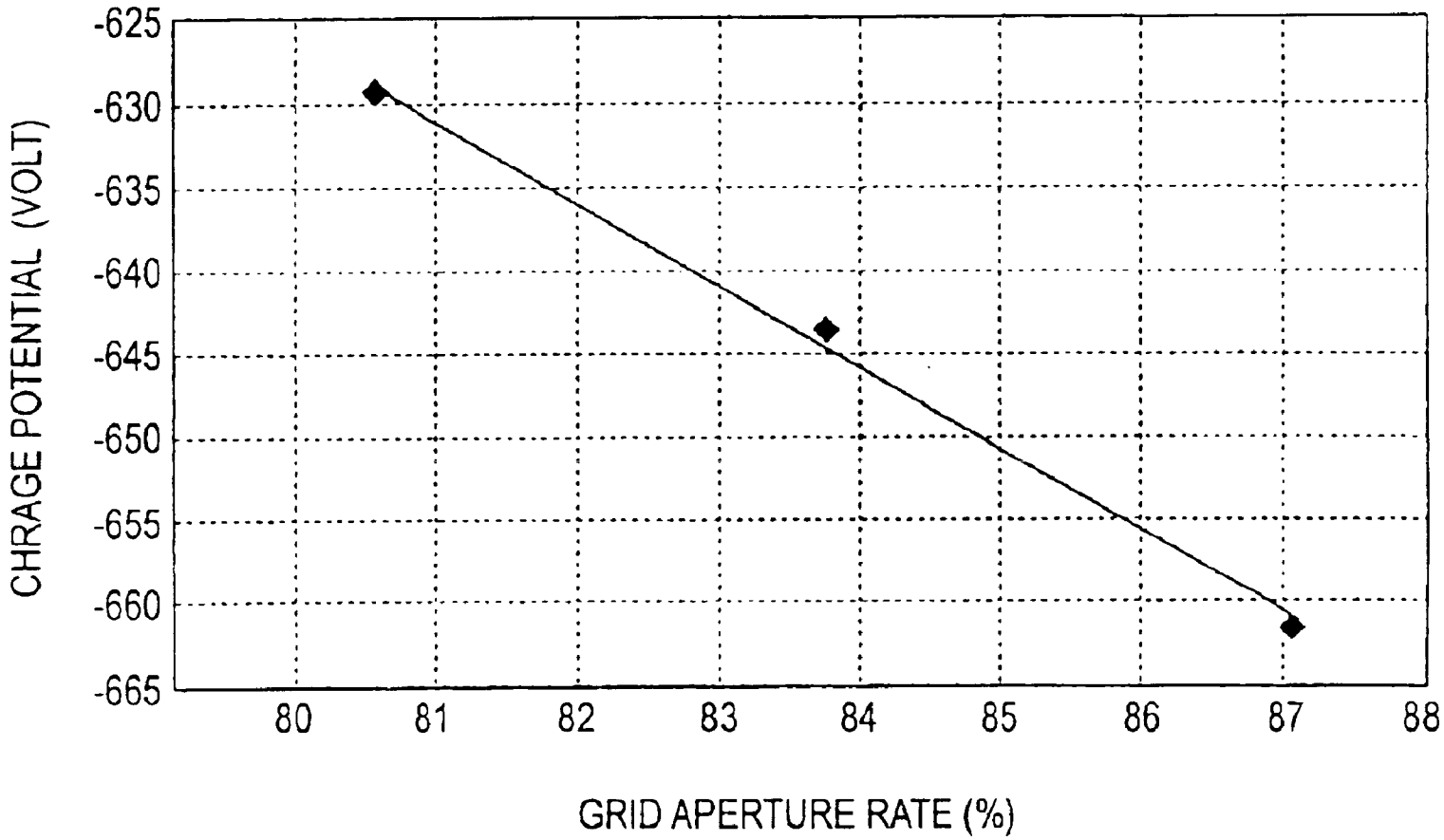
FIG. 5 is a graph of an example of the relationship between the grid aperture rate and the charge potential.

FIG. 5 is a graph of the relationship between the grid aperture rate and the charge potential.

As the graph shows, a 1-percent increase in the grid aperture rate increase the absolute value of the charge potential by about 5 V.

Therefore, nor example, when the grid aperture rate of the first part b1 corresponding to the vent aperture 22*c*3 is set to 87.7 percent where t1R=0.14 mm and t2R=1.00 mm and when the grid aperture rate of the second part 2*b* is set to 84 percent (a difference of about 4 percent) where t1L=0.19 mm and t2L=1.00 mm, the potential difference 20V due to the vent aperture 22*c*3 can be substantially cancelled.

<Third Embodiment>

Figure 6A:
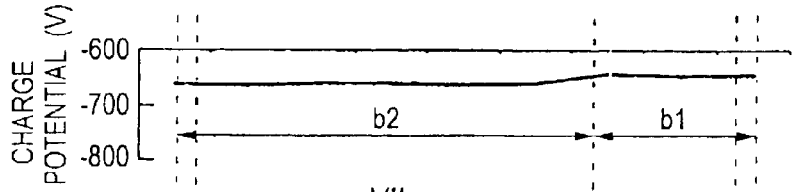
Figure 6B:
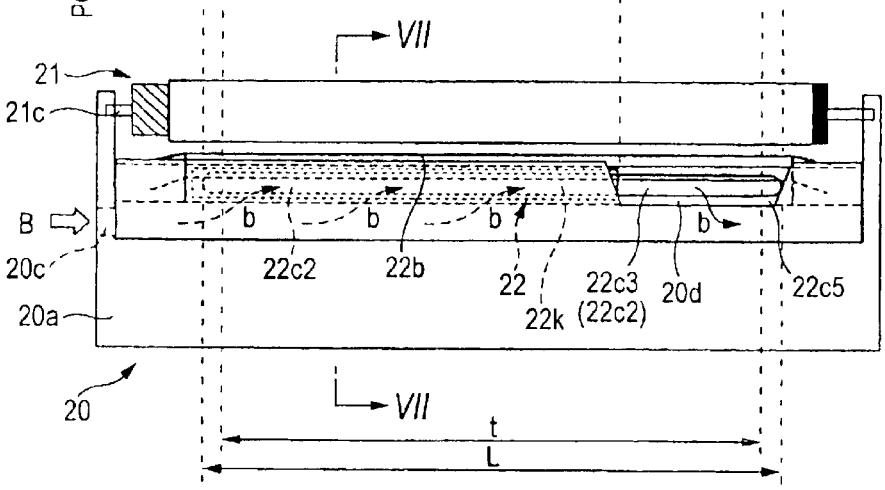
Figure 6C:
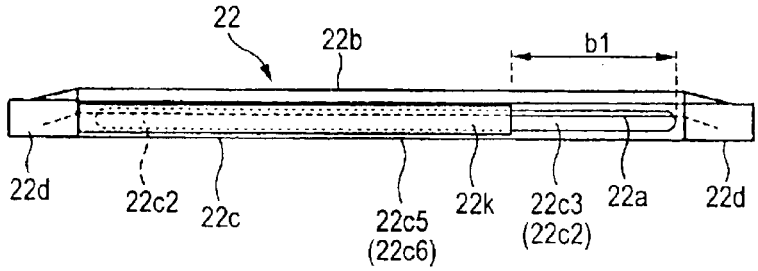
Figure 6D:
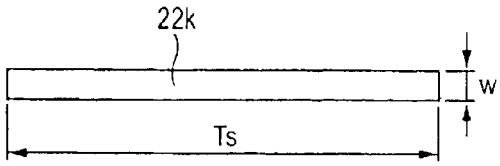
Figure 7:
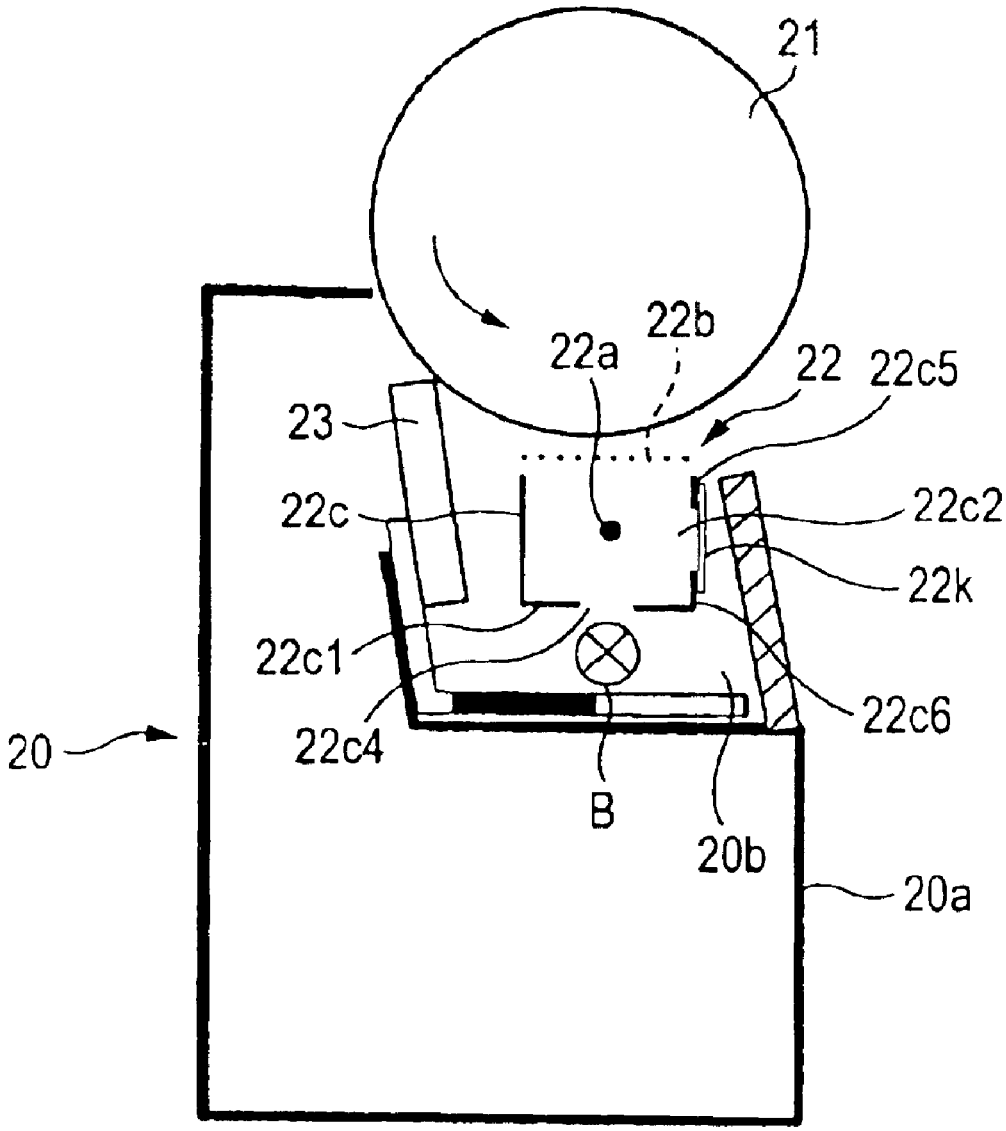
FIG. 7 is a sectional view (schematic view) taken along line VII—VII of FIG. 6B.

FIGS. 6A to 6D are diagrams of essential parts of a third embodiment, wherein FIG. 6A is a graph of a change in charge potential on the surface of the photosensitive body 21 in the axial direction with the aperture set smaller than the maximum width of the image formed by the photosensitive body 21, FIG. 6B is a schematic left side view of the image carrier unit 20, FIG. 6C is a front view of the charger 22 with FIG. 6B viewed from front, and FIG. 6D is a front view of an insulating sheet 22*k*. FIG. 7 is a sectional view (schematic view) taken along line VII—VII of FIG. 6B. In the drawings, components same as or corresponding to those of the first embodiment are given the same reference numerals.

In the embodiment, the charger 22 has an aperture 22*c*2 having a uniform width and a length L larger than the maximum image-formation width t formed by the photosensitive body 21 along the axis (laterally in FIG. 6B) on the side face 22*c*5 of the back plate 22*c*. The aperture 22*c*2 is covered except a part thereof (22*c*3) by the insulating sheet 22*k* applied to an outer surface 22*c*6 (refer to FIG. 7) of the side face 22*c*5 of the back plate 22*c*in the axial direction of the charger 22, thereby forming the uncovered part (22*c*3) of the aperture 22*c*2 as the vent aperture 22*c*3.

The insulating sheet 22*k* has a length Ts shorter than the length L of the aperture 22*c*2 and a width w larger than the width of the aperture 22*c*2, which is applied to the outer surface 22*c*6 of the side face 22*c*5 to form the vent aperture 22*c*3.

Referring also to FIG. 7, the casing 20*a* of the image carrier unit 20 has the duct 20*b*. The duct 20*b* is formed like a substantially U-shape in cross section so as to surround the lower part of the charger 22 and has the air inlet (blast aperture) 20*c* at one end (refer to FIG. 6B) and the exhaust aperture 20*d* at the part opposed to the vent aperture 22*c*3 of the back plate 22*c* at the other end.

The back plate 22*c* has the aperture 22*c*4 on the bottom face 22*c*1 along the axis (in the direction perpendicular to paper in FIG. 7).

Therefore, as shown by arrow b in FIG. 6B, air B flows from the air inlet 20*c* through the aperture 22*c*4 on the bottom face of the back plate 22*c* into the charger 22 and is discharged to the exterior of the image carrier unit 20 through the vent aperture 22*c*3 on the side face and the exhaust aperture 20*d* of the duct.

The image forming apparatus includes the charger 22 having the discharge electrode 22*a*, the back plate 22*c*, and the grid 22*b*, for charging the surface of the photosensitive body 21. An airflow for ventilation by passing air along the back plate 22*c* is provided so that air is discharged to the exterior. The back plate 22*c* has the aperture 22*c*2 having a uniform width a length L larger than the maximum image-formation width t formed by the photosensitive body 21 on the side face 22*c*5, in the axial direction of the charger 22. The aperture 22*c*2 is covered except a part thereof (22*c*3) by the insulating sheet 22*k* applied to the outer surface 22*c*6 of the side face 22*c*5 of the back plate 22*c* in the axial direction of the charger 22 to thereby form the uncovered part (22*c*3) of the aperture 22*c*2 as the vent aperture 22*c*3. Thus, the image forming apparatus offers the same advantages as those of the first embodiment.

On the other hand, if no measures are taken when the vent aperture 22*c*3 is provided, the absolute value of the charge potential on the surface of the photosensitive body 21 at the first part b1 (refer to FIGS. 6A and 6C) corresponding to the vent aperture 22*c*3 would be decreased as compared with the second part b2 (refer to FIG. 6A), as described above.

However, the image forming apparatus has the aperture 22*c*2 having a uniform width and a length L larger than the maximum image-formation width t formed by the photosensitive body 21 in the axial direction of the charger 22, on the side face 22*c*5 of the back plate 22*c*. The aperture 22*c*2 is covered except a part thereof (22*c*3) by the insulating sheet 22*k* applied to the outer surface 22*c*6 of the side face 22*c*5 of the back plate 22*c* in the axial direction of the charger 22, thereby forming the uncovered part (22*c*3) of the aperture 22*c*2 as the vent aperture 22*c*3. Therefore, the entire maximum image-formation width t formed by the photosensitive body 21 is given a uniform charge potential. In other words, since the image forming apparatus has the aperture 22*c*2 with a uniform width and a Length L larger than the maximum image-formation width t formed by the photosensitive body 21 in the axial direction of the charger 22, on the side face 22*c*5 of the back plate 22*c*, the entire maximum image-formation width t formed by the photosensitive body 21 is given uniform electric discharge. As a result, the entire maximum image-formation width t of the photosensitive body 21 can be given a uniform charge potential.

When the aperture 22*c*2 is not covered by the insulating sheet 22*k*, the vent aperture is formed over the length L larger than the maximum image-formation width formed by the photosensitive body 21 to thereby disturb the airflow in the charger 22, which is undesirable. The use of a noninsulating sheet increases the electric discharge at the second part b2 where the sheet is applied and relatively decreases the electric discharge at the first part b1 corresponding to the vent aperture 22*c*3 to decrease the absolute value of the charge potential at the first part b1, as shown in FIG. 6A.

<Fourth Embodiment>

Figure 8A:
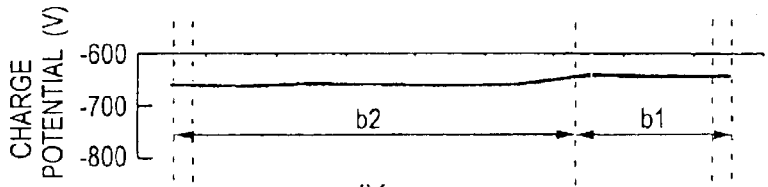
Figure 8B:
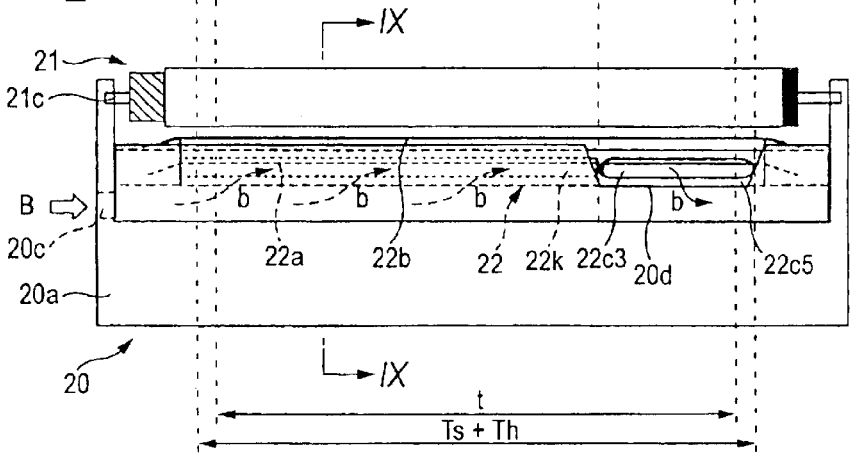
Figure 8C:
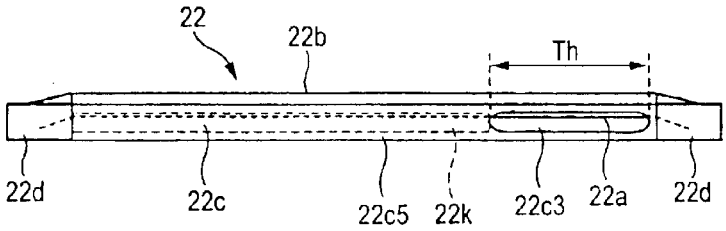
Figure 8D:
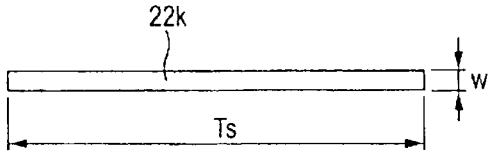
Figure 9:
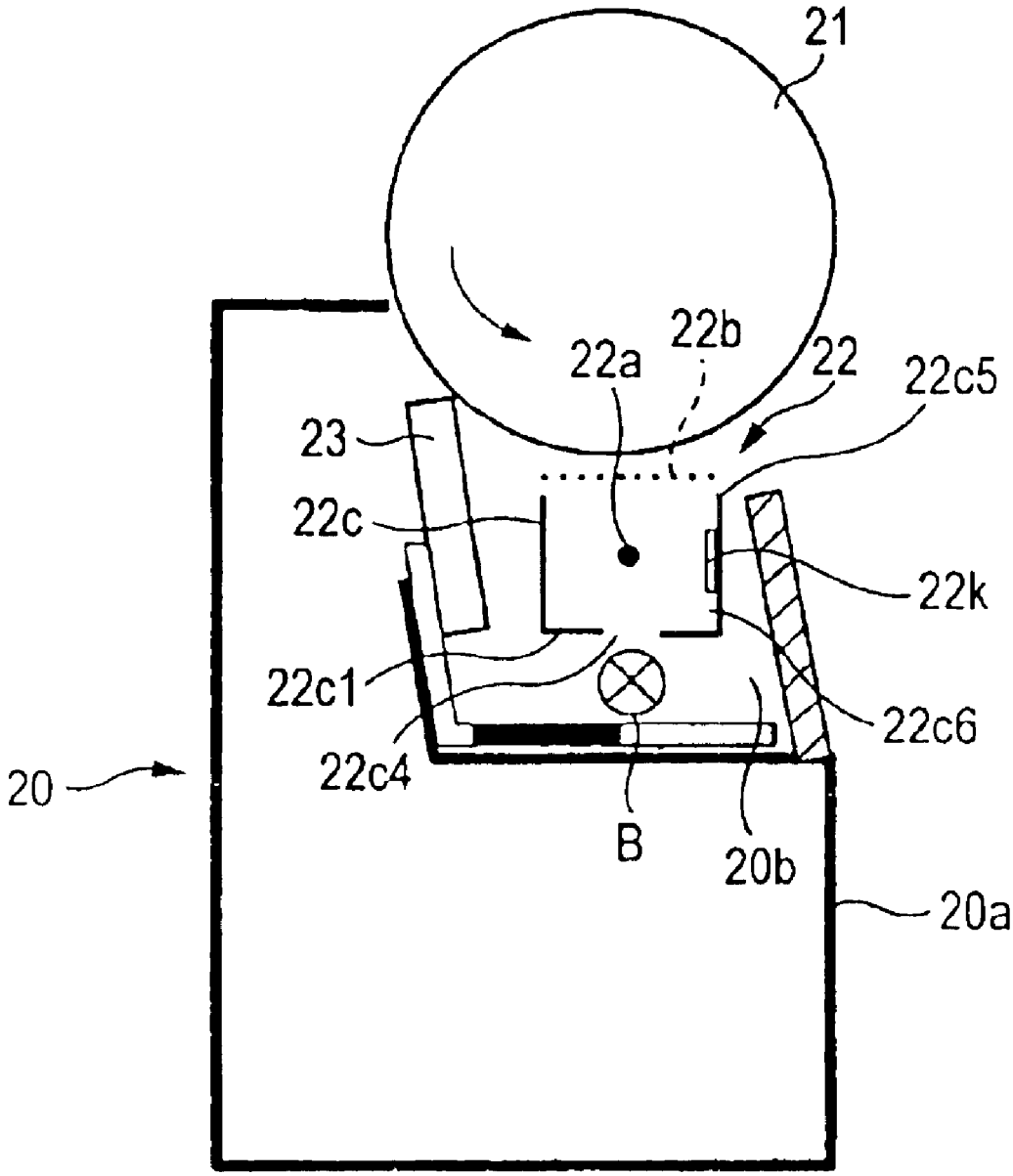
FIG. 9 is a sectional view (schematic view) taken along line IX—IX of FIG. 8B.

FIGS. 8A to 8D are diagrams of essential parts of a fourth embodiments wherein FIG. 8A is a graph of a change in charge potential on the surface of the photosensitive body 21 in the axial direction without correction by the addition of an insulating sheet, FIG. 8B is a schematic left side view of the image carrier unit 20, FIG. 8C is a front view of the charger 22 with FIG. 8B viewed from front, and FIG. 8D is a front view of the insulating sheet 22*k*. FIG. 9 is a sectional view (schematic view) taken along line IX—IX of FIG. 8B. Components same as or corresponding to those of the first embodiment are given the same reference numerals.

In the embodiment, the back plate 22*c* has the vent aperture 22*c*3. on the side face 22*c*5. The insulating sheet 22*k* having a width w substantially equal to that of the vent aperture 22*c*3 is applied to an inner surface 22*c*6 (refer to FIG. 9) of the side face 22*c*5 of the back plate 22*c*, in the axial direction of the charger 22 (laterally in FIG. 8B). The insulating sheet 22*k* is applied to the inner surface 22*c*6 on the extension of the axis of the vent aperture 22*c*3 (or, alternatively, insulating coating is applied like the sheet 22*k*).

The lengths are determined so as to be expressed as $t \leqq Th+Ts$ where t is the maximum image-formation width formed by the photosensitive body 21, Th is the axial length of the vent aperture 22*c*3, and Ts is the axial length of the insulating sheet 22*k*.

Referring also to FIG. 9, the casing 20*a* of the image carrier unit 20 has the duct 20*b*. The duct 20*b* is formed like a substantially U-shape in cross section so as to surround the lower part of the charger 22 and has the air inlet (blast aperture) 20*c* at one end (refer to FIG. 8B) and the exhaust aperture 20*d* at the part opposed to the vent aperture 22*c*3 of the back plate 22*c* at the other end.

The back plate 22*c* has the aperture 22*c*4 on the bottom face 22*c*1 along the axis (in the direction perpendicular to paper in FIG. 9).

Therefore, as shown by arrow b in FIG. 8B, air B flows from the air inlet 20*c* through the aperture 22*c*4 on the bottom face of the back plate 22*c* into the charger 22 and is discharged to the exterior of the image carrier unit 20 through the vent aperture 22*c*3 on the side face and the exhaust aperture 20*d* of the duct 20*b*.

The image forming apparatus includes the charger 22*a* having the discharge electrode 22*a*, the back plate 22*c*, and the grid 22*b*, for charging the surface of the photosensitive body 21. An airflow for ventilation by passing air along the back plate 22*c* is provided so that air is discharged to the exterior. The back plate 22*c* has the vent aperture 22*c*3 on the side face 22*c*5. The insulating sheet 22*k* having a width w substantially equal to that of the vent aperture 22*c*3 is applied to the inner surface 22*c*6 of the side face 22*c*5 of the back plate 22*c*, in the axial direction of the charger 22. Thus, the image forming apparatus offers the same advantages as those of the first embodiment.

If no measures are taken when the vent aperture 22*c*3 is provided, the absolute value of the charge potential of the photosensitive body 21 would be decreased at the first part b1 corresponding to the vent aperture 22*c*3 as compared with at the second part b2 (refer to FIG. 8A), as described above.

On the other hand, with this image forming apparatus, since the insulating sheet 22*k* having a width w substantially equal to that of the vent aperture 22*c*3 is applied to the inner surface 22*c*6 of the side face 22*c*5 of the back plate 22*c*, in the axial direction of the charger 22, a uniform charge potential can be given on the surface of the photosensitive body 21. This is because, although the part having the vent aperture 22*c*3 decreases in the electric discharge by the charger 22 to decrease the absolute value of the charge potential on the surface of the photosensitive body 21 at the first part b1 corresponding to that part (refer to FIG. 8A), when the insulating sheet 22*k* having a width w substantially equal to the width of the vent aperture 22*c*3 is applied to the inner surface 22*c*6 of the side face 22*c*5 of the back plate 22*c* (or, alternatively, insulating coating is applied like the sheet 22*k*), electric discharge by the charger 22 is decreased also at the applied part, so that the absolute value of the charge potential on the surface of the photosensitive body 21 at the second part b2 corresponding to that part is also decreased.

Accordingly, the image forming apparatus can be given a uniform charge potential on the surface of the photosensitive body.

The maximum image-formation width t formed by the photosensitive body is expressed as $$t \leqq Th+Ts$$

where Th is the axial length of the vent aperture and Ts is the axial length of the insulating sheet. As a result, the entire maximum image-formation width formed by the photosensitive body can be given a uniform charge potential.

While preferred embodiments of the invention have been described, the invention is not limited to those and various modifications may be made within the scope and spirit of the invention.

What is claimed is:

1. An image forming apparatus comprising:

a photosensitive body; and a charger including a discharge electrode and a back plate for charging a surface of the photosensitive body, the back plate having an aperture on a bottom face thereof and a vent aperture on a side face thereof, wherein an airflow is provided along the back plate so that air is discharged, wherein an aperture rate of a first part of the bottom face corresponding to the vent aperture on the side face in an axial direction of the charger is lower than an aperture rate of a second part of the bottom face.

2. An image forming apparatus comprising:

a photosensitive body; and a charger including a discharge electrode, a back plate and a grid for charging a surface of the photosensitive body, the back plate having a vent aperture on a side face thereof, wherein an airflow is provided along the back plate so that air is discharged, wherein a grid aperture rate of a first part of the grid corresponding to the vent aperture in an axial direction of the charger is higher than a grid aperture rate of a second part of the grid.

3. An image forming apparatus comprising:

a photosensitive body; and a charger including a discharge electrode and a back plate for charging a surface of the photosensitive body, the back plate having an aperture on a side face thereof extending in an axial direction of the charger with a uniform width and a length larger than a predetermined length needed for image-formation on the photosensitive body, wherein an airflow is provided along the back plate so that air is discharged, and wherein an insulating sheet is applied to an outer face of the back plate so as to cover a portion of the aperture while leaving another portion of the aperture uncovered, constituting a vent aperture.

4. An image forming apparatus comprising:

a photosensitive body; and a charger including a discharge electrode and a back plate for charging a surface of the photosensitive body, the back plate having the back plate has a vent aperture on a side face thereof, wherein an airflow is provided along the back plate so that air is discharged, and wherein an insulating sheet extending in the axial direction of the charger with a width substantially equal to a width of the vent aperture is applied to an inner surface of the side face on which the vent aperture is not formed.

5. An image forming apparatus according to claim 4, wherein a maximum image-formation width t defined on the photosensitive body is expressed as $$t \leqq Th+Ts$$

where Th is an axial length of the vent aperture and Ts is an axial length of the insulating sheet.

* * * * *